United States Patent [19]

Gavin et al.

[11] Patent Number: 4,861,357

[45] Date of Patent: Aug. 29, 1989

[54] VACUUM CLEANER BAR COLLAR

[76] Inventors: Thomas W. Gavin; Michael T. Gavin, both of 3380 Merrick Rd., Seaford, N.Y. 11783

[21] Appl. No.: 192,678

[22] Filed: May 10, 1988

[51] Int. Cl.[4] ..... B01D 46/00

[52] U.S. Cl. ..... 55/367; 55/374; 55/381

[58] Field of Search ..... 55/367, 369, 374, 376, 55/377, 381

[56] References Cited

U.S. PATENT DOCUMENTS

| | | | |
|---|---|---|---|
| 3,108,736 | 10/1963 | Anderson et al. | 229/62.5 |
| 3,297,231 | 1/1967 | Fesco | 229/53 |
| 3,533,868 | 10/1970 | Kowalewski | 55/361 |
| 3,724,179 | 4/1973 | Leinfelt | 55/367 |
| 3,803,815 | 4/1974 | Anderson et al. | 55/367 |

*Primary Examiner*—Bernard Nozick

*Attorney, Agent, or Firm*—Dennison, Meserole, Pollack & Scheiner

[57] ABSTRACT

A mounting collar for a vacuum cleaner bag comprising three or more panels defined from a unitary blank and adhesively bonded in overlying relation to each other. The panels incorporate central aligned openings therethrough which, either in and of themselves or with an adhesively secured elastomeric sheet, provide for a sealing to the exhaust tube of a vacuum cleaner. The blank and the individual panels formed therefrom are from a low caliper stock paperboard material within the range of 15-30 points (0.015 inch to 0.030 inch). The intermediate panel or panels of the overlying panels are peripherally smaller than the outer panels and have the openings therein peripherally larger than the aligned openings in the outer panel.

21 Claims, 3 Drawing Sheets

VACUUM CLEANER BAR COLLAR

BACKGROUND OF THE INVENTION

The invention is broadly concerned with collection bags for vacuum cleaners, and in particular the mounting collars for such bags which seal the bags, in an airtight manner, to the air exhaust tubes of the vacuum cleaners. Such collars conventionally comprise either a single panel of thick paperboard or a pair of overlying panels. The actual sealing of the collar to the tube is effected through a frictional engagement of the collar with the tube utilizing a variety of means. Most common is the provision of a centrally apertured resiliently flexible elastomeric sheet adhesively bonded to one face of a collar panel over the central opening therethrough with the sheet flexing as the collar is introduced over the tube and maintaining itself in intimate sealing engagement with the tube. In an alternative arrangement, the panel can be provided with a sunburst effect, comprising a series of slits extending radially outward from the central collar opening to allow flexing of the panel about the opening in response to movement of the collar onto the tube for an enhanced sealing therewith. The sunburst effect and variations thereof are also particularly effective in securing the collars on tubes incorporating a positioning stop or abutment behind which the collar engages.

In those instances wherein the collar is defined by a pair of overlying adhesively bonded panels, the elastomeric sheet, can, as desired, be positioned between the panels rather than on an exterior face of one of the panels. Likewise, one of the panels can incorporate a sunburst effect or variation thereof for cooperation with the elastomeric sheet.

It is essential that the collar, other than whereat special provision is made for deformation when sealing to the tube, avoid bending or distortion which could cause a hole and air leakage, thus making the bag useless. Accordingly, the conventional collar, whether formed of one or two panels, utilizes thick paperboard with a caliper on the order of at least 31 points (0.031 inch) or greater. While paperboard of such high caliper is available, the bulk of paperboard is made in a range of 15–30 points with the broadest grades of paperboard being available within this range.

The high caliper paperboard, that is above 30 points, is made by only a few mills which must run their equipment at slower speeds to allow for more fiber build up. Further, as mills generally prefer to run their machinery at high speeds and produce calipers of greater demand, the mills that do run these high calipers consider them special production and upcharge for them.

Another problem associated with heavy caliper paperboard arise in the manner in which the paperboard is to be supplied for manufacture into the collars. For example, the conventionally used high caliper paperboard cannot readily be supplied in rolls because of the substantial tendency for the high caliper paperboard to warp near or at the roll core. Further, for any substantial shipping, storing and manufacturing economies, any rolls provided would have to be of substantial diameter. However, large diameter rolls, for example 6 foot rolls with a width of 4½ inches for a single ply collar or 9 inches for a double ply collar (assuming a blank folded on itself to define the dual panels) would be impractical and probably dangerous in a high speed manufacturing operation.

Of particular interest with regard to the manufacture of a two panel collar is the patent to Kowalewski, 3,533,868, issued Oct. 13, 1970, wherein the collars are formed from cardboard sheets.

The environment of the invention and the state of the known prior art will also be noted in the following patents:

3,108,736: E. ANDERSON ET AL
3,297,231: J. J. FESCO
3,803,815: ANDERSON ET AL

The two patents to Anderson et al illustrate two-panel collars formed from single blanks. Fesco, while referring to three panels, utilizes only the central apertured panel as a mounting means.

SUMMARY OF THE INVENTION

The collar of the present invention is specifically formed of three or more panels folded from a single blank and adhesively bonded in overlying relation to each other. The collar, so formed, will incorporate means for sealing in surrounding relation to the exhaust tube of a vacuum cleaner for mounting of a dust bag thereon.

The panels, and the blank from which the panels are formed are of a low caliper or thickness within the range of 15–30 points (0.015 inch–0.30 inch). Utilization of paperboard within this caliper range, which is within the range of the bulk of the paperboard manufactured, insures the availability of the paperboard and the broadest range of grades, finishes, and the like.

In addition, the use of paperboard of lower thickness or caliper allows for provision of the paperboard in rolls. More specifically, the tendency for the lower caliper paperboard to warp, as compared to the high caliper paperboard, is substantially reduced to the point where provision of the paperboard in rolls is practical. Similarly, the formation of the collars from blanks incorporating three defined panels provides for a sufficient width to allow for stable rolls of substantial diameter, up to six feet or more. This in turn allows for longer runs during the collar manufacturing procedures, and a resultant greater efficiency.

While the invention proposes the use of lower caliper panels than heretofore considered necessary for proper rigidity and strength, by the utilization of at least three panels in overlying adhesively bonded engagement with each other, the resultant collar has been found to be of greater strength and rigidity than the conventional collar. In addition, three or more panels allow for a wider range of placement for the collar-sealing apertured elastic or rubber sheet, with the sheet having two panels to one side thereof.

The individual collars are formed from one-piece blanks with the panels, during the manufacturing procedure, provided with appropriate air seals and sequentially folded and adhesively bonded in overlying relation to each other to provide a rigid unit bondable directly to a dust bag and in turn frictionally mountable on the exhaust tube of a vacuum cleaner.

Utilizing a three-blank panel, the preferred manner of folding consists of folding one end panel over the central panel and subsequently folding the second end panel over the first end panel, sandwiching the first end panel between the second end panel and the central panel of the blank. In order to provide for a proper nesting of the first end panel, to avoid buckling, aperture interference, and the like, as well as to allow for some manufacturing tolerance in the formation of the blanks and the high speed folding thereof, the first end panel is peripherally reduced relative to the other two panels, and has the central aperture therein larger than the aligning apertures through the remaining two panels. Thus, upon a folding of the first end panel over the central panel, the peripheral edge of the first end panel will be inwardly offset or set back from the peripheral edge of the central panel, and the aperture in the first end panel will be peripherally outwardly offset relative to the corresponding aperture in the central panel. The second end panel, upon folding over the first end panel, aligns with the central panel and bears a similar relationship to the first end panel. Thus formed, the first end panel, which is the intermediate panel in the folded collar, defines a positive reinforcing and stabilizing inner panel without a disruption in the periphery of the formed collar or the central mounting aperture therethrough, and without a disruption in the desired substantially planar nature of the formed collar. In obtaining the proper overlying relationship of the panels, and in particular the second end panel or the last panel to be folded, the fold line defined between this second end panel and the central panel is of a greater width than the fold line between the first end panel and the central panel so as to accommodate the thickness of the previously folded first end panel.

In a four-panel blank the initial folding involves an inward folding of the two end panels over the respective adjoining inner panels. In this case, each of the end panels is peripherally reduced relative to the inner panels and include central apertures larger than the apertures in the inner panels. The inner panels will define the outer panels of the folded collar with the final fold of the blank involving a folding of the inner panels over each other with the two end panels confined therebetween. The fold line between the two inner panels will be of a width substantially greater than the fold lines between each end panel and the adjoining inner panel so as to accommodate the extra thickness of the stacked panels.

Other objects and advantages of the invention will become apparent from the following description of the invention wherein reference is specifically made to the drawings.

DESCRIPTION OF PREFERRED EMBODIMENTS

Figures 1, 2, 3, 4:
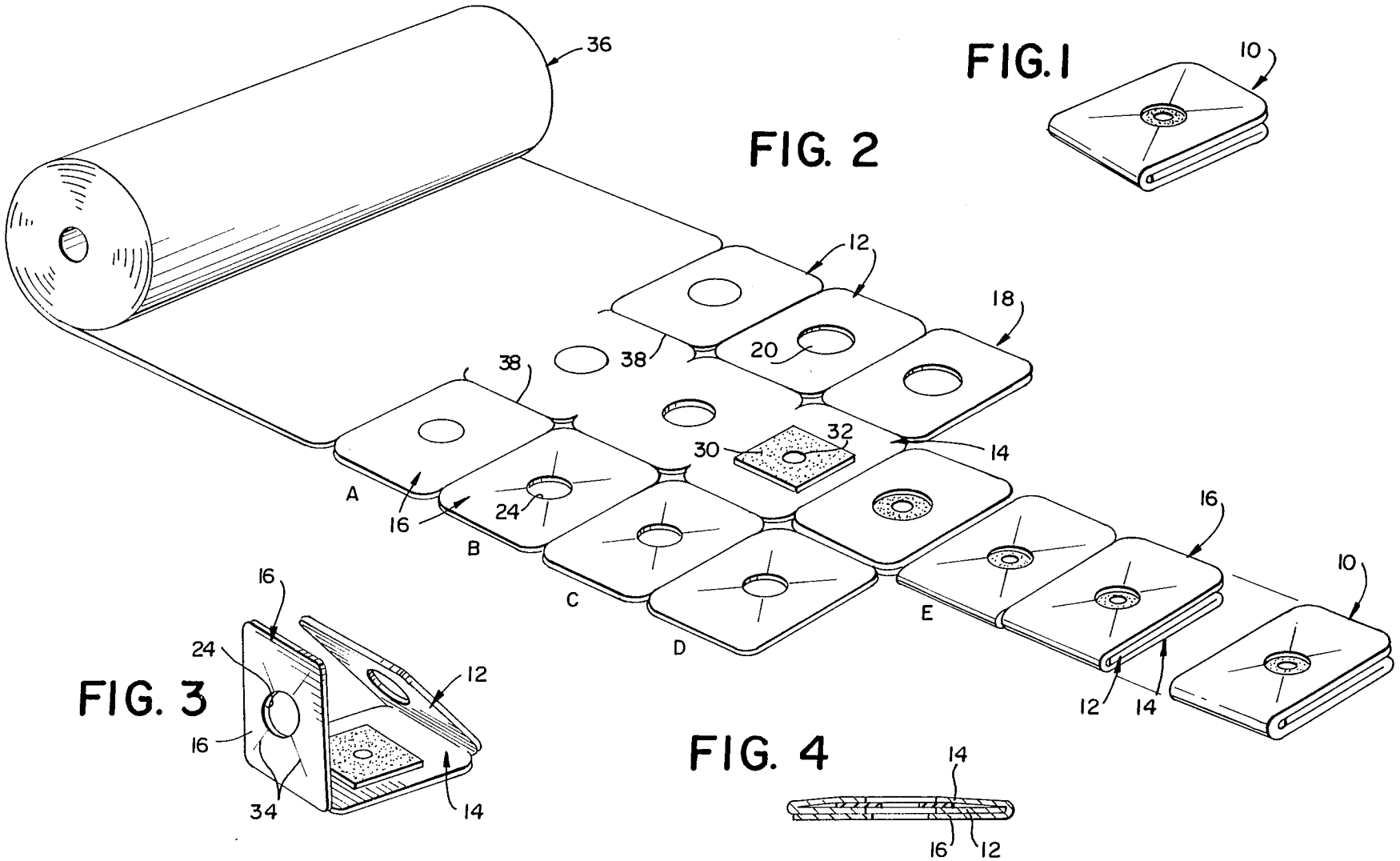
FIG. 1 is a perspective view of a bag collar in accord with the present invention.
FIG. 2 is a generally schematic representation of the procedure for forming the bag collars.
FIG. 3 is a perspective view illustrating the manner of folding the panels to define the collar.
FIG. 4 is a cross-sectional detail through a collar folded in the manner of FIG. 3.
Figure 5:
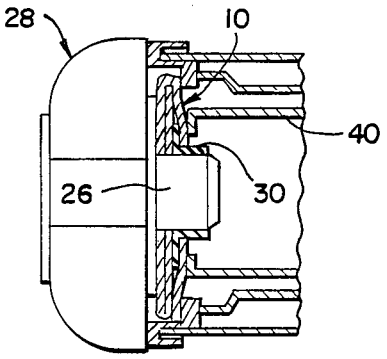
FIG. 5 is a cross-sectional detail illustrating the environment of use of the collar in mounting a dust bag on the exhaust tube of a vacuum cleaner.

Referring now more specifically to the drawings, reference numeral 10 illustrates a mounting collar constructed in accord with the present invention. The collar 10 is formed of three panels 12, 14 and 16 folded from a single blank 18 of low caliper paperboard within the range of 15–30 points.

The panels, 12, 14 and 16 include central apertures therethrough respectively designated as 20, 22 and 24 which coaxially align in the formed collar 10 for reception of the exhaust tube 26 of a vacuum cleaner 28 therethrough.

The panels 12, 14 and 16 are intimately adhesively bonded in face-to-face relation with each other throughout the full extent of overlying contact with the combined thickness of the three panels substantially equaling that of the conventional single or double panel collar while at the same time providing substantially greater strength through the multiple adhesively bonded panels and in particular the adhesive or glue layers between and intimate with the panels.

The collar 10, as with the conventional collar, can incorporate an elastomeric or rubber air seal sheet 30. The sheet 30 is preferably bonded over one face of the intermediate or central panel 14 whereby the sheet 30 will be effectively backed by at least two panels thicknesses for greater collar rigidity and the rejection of any tendency for the collar to bend or distort in response to deflection of the sheet 30. The sheet 30, as illustrated, includes a central aperture 32, either a hole or slit, smaller than the opening 22 through the central panel 14 to which the sheet 30 is mounted for a resiliently flexing intimate engagement with the mounting tube 26. While, for purposes of illustration, and in particular in the cross-sectional details, the elastomeric or rubber sheet 30 has been shown of substantial thickness, it is to be appreciated that the sheet 30 is actually substantially thinner than the thickness or caliper of the panels and does not preclude a direct bonding of the panels sandwiching the sheet 30 to each other with no noticeable distortion in the planar nature of these panels.

As desired, additional forms of sealing can be provided for use in conjunction with or in place of the sealing sheet 30. One form relies on the sunburst effect wherein outwardly directed radial lines 34 are provided at spaced points about the panel aperture, either 20 or 24. Such an effect is known in the art and allows for a flexing of the peripheral portion of the aperture for intimate engagement with the tube 26, as well as a possible locking engagement with a tube abutment. As suggested in FIG. 3, such a sunburst effect will normally be provided in the last folded panel.

Noting FIG. 2, the mounting collar 10 is preferably formed from rolled stock material 36 in a sequential series of steps designated by letters A–F. As the material moves from the roll, the initial step A involves defining the three-panel blank by die cutting the opposed edges of the end panels 12 and 16, forming nonperforating fold lines 38 between each of the end panels and the central panel 14, and die cutting the panel central apertures. At step B the waste material is ejected. At step C, the elastomeric sheet 30 is glued in position over the aperture in the appropriate panel, for example the central panel 14 as illustrated. At step D one of the end panels, the panel 12 as illustrated, is folded to overlie the central panel 14 and is intimately adhesively bonded in face-to-face contact therewith. At step E, the second end panel, panel 16, is folded to stack with the panels 12 and 14, overlying and directly bonding to panel 12 as illustrated. At the final step, step F, the completed collar is severed by a severing of the central panel 14 which up to this point has been unitary with the material as it traveled through the steps.

While the collar 10 has been illustrated as defined by rectangular panels with circular openings therethrough, both the shape of the collar and the shape of the openings can vary in accord with the particular nature of the dust bag 40 to which the collar is to be secured and the configuration of the exhaust tube 26 to which the collar is to mount.

Figure 6:
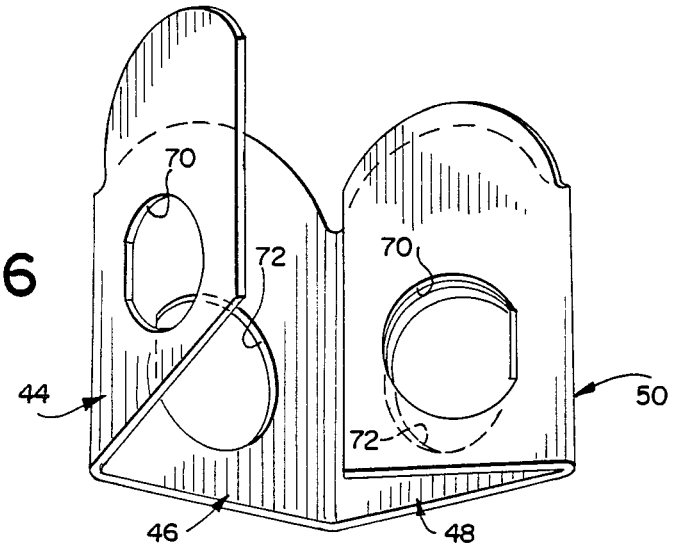
FIG. 6 is a perspective view of a partially folded four-panel collar.
Figure 7:
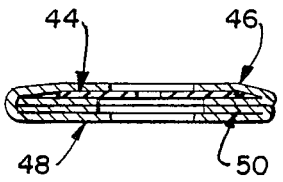
FIG. 7 is a cross-sectional detail through a collar folded in the manner of FIG. 6.

FIGS. 6 and 7 illustrates a variation of the collar 42 wherein four panels 44–50 are provided. While more than four panels are also contemplated, as a practical matter the improved collars of the invention will normally incorporate either three or four panels as illustrated. The use of four panels vis-a-vis three panels allows for lower caliper paperboard and the efficiencies and economies associated therewith, as well as the enhanced strength derived from the multiple glue-joined panels.

As will be readily recognized, the sealing sheet of elastomeric material 52 can be accommodated internally between a pair of panels in any of three locations. Similarly, a collar retaining sunburst effect can be provided with the sizes and configurations of the panel openings being such as to accommodate the specifics of the exhaust tube to which the collar is to mount.

Figure 8:
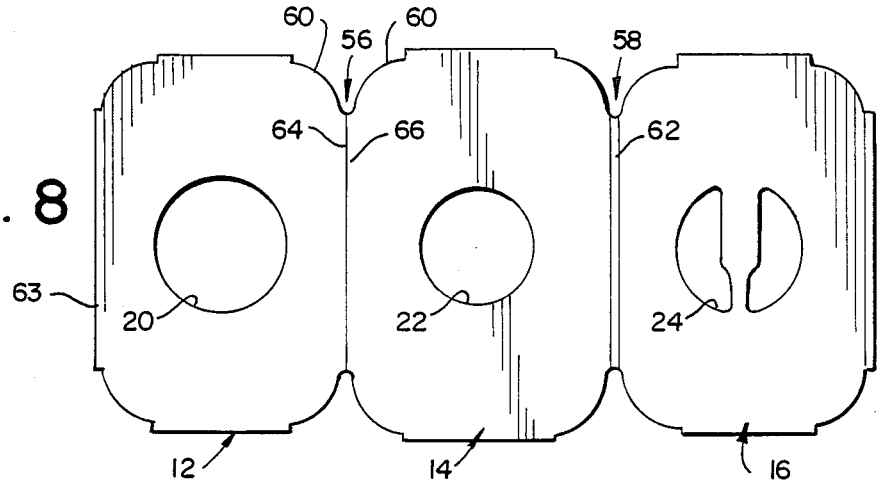
FIG. 8 is a plan view of a three-panel blank illustrating the structural relationships between the panels thereof.
Figure 9:
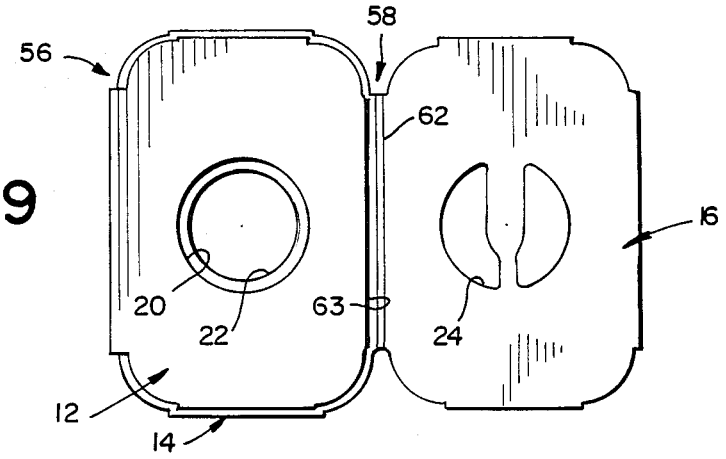
FIG. 9 is a plan view of the three-panel blank with the first end panel folded over the central panel.

Referring now more particularly to the structure of the blank 18 and the panels 12, 14 and 16 formed therefrom, attention is directed to FIG. 8. The individual panels, formed from the one-piece blank 18, are joined at the inner edges thereof by integral joinder areas 56 and 58. These joinder areas are of a length, transversely across the blank 18, less than the transverse width of the blank and the defined panels, terminating inward of the opposed longitudinal edges of the blank to both provide a positive joinder between the panels and at the same time leave the adjoining corners and edges of the panel, as at 60, free for configuration in accord with the ultimate configuration required for the formed collar. In the three-panle embodiment of FIGS. 8 and 9, the joinder areas 56 and 58 terminate inward of both longitudinal edges of the blank allowing for an arcuate configuration of the corner areas 60.

The panels 12 and 16 respectively constitute the first and second end panels to the opposite sides of the central panel 14. The central panel 14 and second end panel 16 are of equal size with the joinder area 58 therebetween having a longitudinally extending central fold line 62.

The first end panel 12 is smaller than the panels 14 and 16 with the periphery thereof, at least along the outer free transverse edge 63 thereof, inwardly offset or set back. This relationship will best be appreciated from FIG. 9 wherein the first end panel 12 has been folded to overlie the central panel 14. As noted, the outer free peripheral edge 63 terminates just inward of the fold line 62. If desired, and as also illustrated, the entire periphery of panel 12 can be reduced whereby the periphery of the central panel 14 is exposed completely about the overlying first end panel 12.

As illustrated, the panels 12, 14 and 16 have the central apertures 20, 22 and 24 therethrough. The apertures 22 and 24 in the central and second end panels 14 and 16 are of equal size and particularly adapted to retentively conform to the vacuum cleaner tube 26 or the like to which the collar is to be attached. The aperture 20 in the first end panel 12, the intermediate panel in the folded collar, is peripherally enlarged relative to the apertures 22 and 24. This particular relationship will again be best appreciated from FIG. 9 wherein the periphery of the central panel aperture 22 is exposed substantially equally completely about the larger aperture 20.

In order to insure a proper folding and positioning of the first end panel 12 in centered relationship over the central panel 14, the joinder area 56 between the panels 12 and 14, through an inward set back of the inner peripheral edge of the panel 12, is slightly wider, as indicated at 64, between the coresponding fold line 66 and the panel 12, as compared to the width of the joinder area 56 between the fold line 66 and the central panel 14. Thus, upon a folding of the panel 12 about the corresponding fold line 66, the extra width of the joinder area at 64 positions the first end panel 12 centrally over the central panel 14.

Inasmuch as the second end panel 16, upon being folded to overly the folded first end panel 12, will have to accommodate the additional thickness of the first end panel 12, the fold line 62 between panels 14 and 16 is itself of a greater width than the fold line 62 between the first end panel 12 and the central panel 14, thus allowing for an accommodation of the first end panel 12 and a positioning of the second end panel 16 into flat overlying relation thereto. This folding of the second end panel 16 is also accommodated by the slight inward set back of the free transverse outer edge of the first end panel 12 from the fold line 62 between panels 14 and 16. Referring again to the relative widths of the joinder areas 56 and 58 and portions thereof, the joinder area 58 between the panels 14 and 16 is of equal width to the opposite sides of the central fold line 62 therealong. In the joinder area 56 between the panels 12 and 14, the width thereof between the central fold line 66 and the central panel 14 is approximately equal to the width of the two portions of the joinder area 58 between panels 14 and 16 to the opposite sides of the central fold line 62. The width of the joinder portion 56 to the first end panel 12 side 64 thereof is greater so as to centrally position the first end panel 12 over the central panel 14, notwithstanding the set-back peripheral edges thereof.

The size relationship between the first end panel 12 and the overlying and underlying central and second end panels is significant in providing for the desired thickness and rigidity without any tendency for the layered panels to buckle or distort. Further, the set-back nature of the outer periphery of the first end panel 12 and the aperture 20 therein avoids any possibility of aperture interference, that is interference with the openings defined by the apertures 22 and 24 in the two outermost panels in the folded collar, which in turn have been configured to specifically conform the collar to the mounting tube 26 in a manner which will achieve the desired air seal.

The set back of the outer periphery of the first end panel 12 avoids any tendency for a disruption of the peripheral configuration of the folded collar, notwithstanding minor misalignment as may occur during manufacturing procedures.

Figure 10:
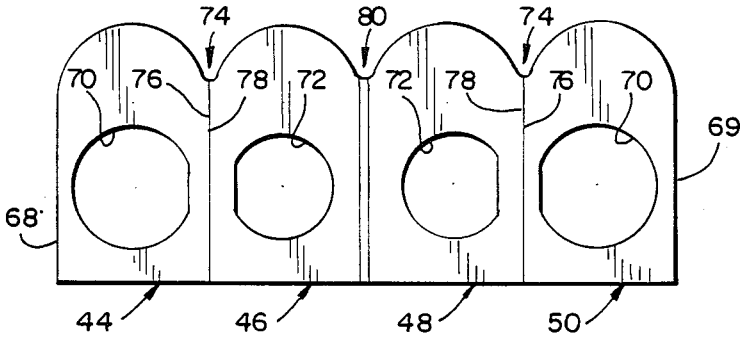
FIG. 10 is a plan view of a four-panel blank illustrating the structural relationship between the panels.
Figure 11:
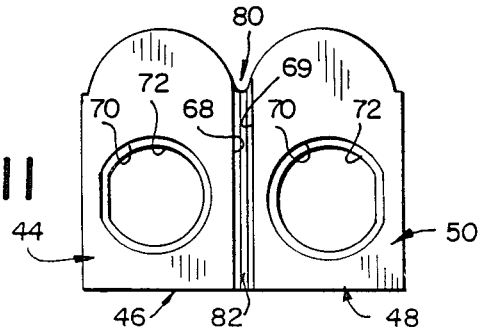
FIG. 11 is a plan view of the four-panel blank with the two end panels folded over the intermediate panels.

FIGS. 10 and 11 illustrate the blank and initial folding steps of the four panel construction with the panels, as in FIG. 6, designated respectively as 44, 46, 48 and 50. In this construction the joinder areas between the panels are coextensive with one longitudinal edge of the blank and define a transition point between the arcuate opposite ends of the panels aligned along the opposite longitudinal edge of the blank.

The two end panels 44 and 50 are, in the manner of the first end panel 12 of FIG. 8, slightly peripherally smaller than the two intermediate panels 46 and 48. That is, the peripheral edges thereof, normally solely along the outer transverse edges 68 and 69, are set back slightly relative to the peripheries of the intermediate panels 46 and 48. This relationship will best be appreciated from FIG. 11 wherein, as an initial folding step, the two end panels 44 and 50 are inwardly folded to overly the respective adjacent intermediate panels 46 and 48.

The central apertures 70 through the end panels 44 and 50, while configured similarly to the apertures 72 in the intermediate panels, are larger than the apertures 72, being slightly peripherally set back or outward completely thereabout. This relationship will also best be noted in the first fold step of FIG. 11.

In order to accommodate the proper central positioning of the end panels 44 and 50 over their respective adjacent intermediate panels 46 and 48, the joinder areas 74 between each end panel and the adjacent intermediate panel will be slightly wider, as indicated at 76, between the intermediate longitudinally extending fold line 78 and the respective end panel, as compared to the width of the joinder area 74 between the fold line 78 and the intermediate panel. This relationship is the same as that discussed with regard to the first end panel 12 and central panel 14 of FIG. 8.

The joinder area 80 between the two intermediate panels 46 and 48 is of equal width to the opposite sides of the central fold line 82. The width of the joinder area 80 to each side of fold line 82 is generally equal to the width of the joinder areas 74 between the fold lines 78 therein and the intermediate panels. Inasmuch as the two end panels 44 and 50 are to be sandwiched between the intermediate panels 46 and 48, the fold line 82 in the joinder area 80 between the intermediate panels 46 and 48 is relatively substantially wider than the fold lines 78 to enable a folding of the intermediate panels 46 and 48 to sandwich the end panels 44 and 50 therebetween without buckling and in a manner so as to provide for a smooth planar relationship of the layered panels in the finished collar. Formed in this manner, the sandwiched end panels 44 and 50, while providing for the desired thickness and strength in the formed collar, do not interfere, even assuming minor alignment problems, with the specifically sized aligned outer apertures 72 in the finished collar through which the vacuum cleaner exhaust tube is to engage.

From the foregoing it is to be appreciated that the formation of cleaner bag collars utilizing three or more panels and low caliper paperboard, within the range of 15–30 points, results in significant improvements and advantages. Such advantages include the ready availability of a great variety of stock paperboard as opposed to the special manufacture and expensive paperboard conventionally used in the single or double panel collars. Other advantages include the ability, through the low caliper of the paperboard, to provide the paperboard in large rolls, both a storing and shipping convenience which also allows for longer manufacturing runs as compared to the use of stacked sheets of stock material necessitated by the higher caliper paperboard. Further advantages include the substantial structural rigidity and strength achieved by the bonded multiple panels, and the versatility in positioning the seal means, for example an elastomeric sheet and such other means as a sunburst effect, for collar retention. It is also considered significant that the provision of three or four panels allows for the use of different inside diameter holes in different panels to obtain a significant air seal either with or without the elastomeric sheet whereby a progressive intimate contact with the exhaust tube is possible. As will be recognized, the holes as well as any additional air seals associated therewith, will in each instance be configured in accord with the particular tube to which the collar is to mount.

The foregoing is illustrative of the principles of the invention, and modifications and variations as may occur to those skilled in the art are to be considered within the scope of the invention.

We claim:

1. A mounting collar for a collection bag, said collar being engageable on the exhaust tube of a vacuum cleaner, said collar comprising at least three panels in face-to-face overlying relation with each other, adhesive means between adjacent panels bonding the panels intimately to each other, each of said panels having an opening defined therethrough, said opening being in alignment for engagement of an exhaust tube therethrough, one of said panels having sealing means for sealing the collar to the tube, each panel being of a thickness of between 0.015 inch and a maximum thickness of 0.030 inch.

2. A vacuum cleaner bag collar for engagement on the exhaust tube of a vacuum cleaner, said collar comprising at least three aligned integral panels defined from a unitary blank, said panels being folded in face-to-face overlying relation with each other, each of said panels having an aperture defined centrally therethrough, said apertures being in registry, a sheet of thin elastic material secured between a pair of face-to-face panels with at least two of said panels being to one side of said sheet of elastic material, said sheet having a central aperture defined therethrough in registry with the apertures through the panels, and means securing said panels in folded face-to-face relation with each other.

3. The bag collar of claim 2 wherein said blank is of paperboard with a caliper of 0.015 inch to 0.030 inch.

4. The bag collar of claim 3 wherein at least one of said panels is configured, adjacent the aperture therein, to provide sealing means in addition to said sheet of elastic material.

5. The bag collar of claim 3 including four panels.

6. A mounting collar for a collection bag, said collar being engageable on the exhaust tube of a vacuum cleaner, said collar comprising at least three panels integrally formed from a unitary blank and folded into face-to-face overlying relation with each other, each of said panels being of a maximum thickness of 0.030 inch, adhesive means between adjacent panels bonding the panels intimately to each other, each of said panels having an opening defined therethrough, said openings being in alignment for engagement of an exhaust tube therethrough, and one of said panels having sealing means for sealing the collar to the tube.

7. The mounting collar of claim 6 wherein said panels comprise first and second end panels and a central panel therebetween, said second end panel and said central panel being of equal size, said first end panel being peripherally reduced relative to the other two panels and folded to lie centrally therebetween with the periphery of the first end panel being inwardly offset from the periphery of the second end panel and the central panel.

8. The mounting collar of claim 7 wherein the openings in the second end panel and the central panel are of substantially equal size, the opening in the first end panel being larger and peripherally outwardly offset relative to the aligned openings of the second end panel and central panel.

9. The mounting collar of claim 8 including joinder areas integrally formed between said central panel and each of said first and second end panels, each joinder area having a fold line therealong paralleling adjacent panel edges, in the joinder area between said central panel and said first end panel, said joinder area being wider between the fold line therein and the first end panel than between the fold line therein and the central panel for an inward positioning of the adjoining edge of the first end panel relative to the adjoining edge of the central panel upon a folding of said panels.

10. The mounting collar of claim 8 wherein said sealing means comprising an elastomeric sheet affixed to said one of said panels in overlying relation to the opening therethrough, said sheet having an opening defined therethrough which is central with and smaller than the opening through the panel to which the sheet is affixed.

11. The mounting collar of claim 10 wherein said sheet is sandwiched between two panels with two panels to one side of said sheet.

12. The mounting collar of claim 8 wherein said sealing means comprises foldable portions defined in the said one of said panels at the opening defined therethrough.

13. The mounting collar of claim 12 including a second sealing means comprising an elastomeric sheet affixed to a second of said panels in overlying relation to the opening therethrough, said sheet having an opening defined therethrough which is central with and smaller than the opening through the panel to which the sheet is affixed.

14. A mounting collar for a collection bag, said collar being engageable on the exhaust tube of a vacuum cleaner, said collar comprising at least three panels in face-to-face overlying relation with each other, adhesive means between adjacent panels bonding the panels intimately to each other, each of said panels having an opening defined therethrough, said openings being in alignment for engagement of an exhaust tube therethrough, one of said panels having sealing means for sealing the collar to the tube, said panels being integrally formed from a unitary blank and comprising first and second end panels and a central panel therebetween, said second end panel and said central panel being of equal size, said first end panel being peripherally reduced relative to the other two panels and folded to lie centrally therebetween with the periphery of the first end panel being inwardly offset from the periphery of the second end panel and the central panel.

15. The mounting collar of claim 14 wherein said end panels have free transverse outer edges and transverse inner edges integral with the central panel, the inwardly offset periphery of the first end panel being defined along the free transverse outer edge thereof.

16. The mounting collar of claim 15 wherein the openings in the second end panel and the central panel are of substantially equal size, the opening in the first end panel being larger and peripherally outwardly offset, completely thereabout, relative to the aligned openings of the second end panel and central panel.

17. A mounting collar for a collection bag, said collar being engageable on the exhaust tube of a vacuum cleaner, said collar comprising at least three panels in face-to-face overlying relation with each other, adhesive means between adjacent panels bonding the panels intimately to each other, each of said panels having an opening defined therethrough, said openings being in alignment for engagement of an exhaust tube therethrough, one of said panels having sealing means for sealing the collar to the tube, said panels being integrally formed from a unitary blank and comprising two intermediate panels having inner and outer transverse edges, the inner edges of the intermediate panels being integrally joined by a joinder area having a central fold line paralleling said inner edges, first and second end panels having inner and outer transverse edges, a joinder area integrally joining the inner edge of each end panel to the outer edge of a corresponding intermediate panel and including a fold line therealong parallel to the inner edge of the corresponding end panel, said intermediate panels being of equal size, said end panels being of equal size peripherally reduced relative to the intermediate panels and folded to lie centrally between the intermediate panels with the peripheries of the end panels, at least along the traverse outer edges thereof, being inwardly offset from the peripheries of the intermediate panels.

18. The mounting collar of claim 17 wherein the openings in the intermediate panels are of substantially equal size, the openings in the end panels being of substantially equal size larger than and peripherally set back outwardly of the openings in the intermediate panels.

19. The mounting collar of claim 18 wherein, in the joinder area between each intermediate panel and the adjacent end panel, the joinder area is wider between the fold line and the end panel than between the fold line and the corresponding intermediate panel for an inward offsetting of the inner edge of the end panel relative to the outer edge of the corresponding intermediate panel upon a folding of said panels.

20. A mounting collar for a collection bag, said collar being engageable on the exhaust tube of vacuum cleaner, said collar comprising at least three panels integrally formed from a unitary blank and folded in face-to-face overlying relation with each other, adhesive means between adjacent panels bonding the panels intimately to each other, each of said panels having an opening defined therethrough, said openings being in alignment for engagement of an exhaust tube therethrough, said collar including means for sealing the collar to the tube.

21. The mounting collar of claim 20 wherein selected ones of the openings in alignment for engagement of an exhaust tube therethrough have different diameters and are configured for progressive intimate contact with an engaged exhaust tube to defining said means for sealing the collar to the tube.

* * * * *

UNITED STATES PATENT AND TRADEMARK OFFICE

CERTIFICATE OF CORRECTION

PATENT NO. : 4,861,357

DATED : August 29, 1989

INVENTOR(S) : Thomas W. Gavin and Michael T. Gavin

It is certified that error appears in the above-identified patent and that said Letters Patent is hereby corrected as shown below:

In the title, change "Bar" to -- Bag -- so that the title correctly reads VACUUM CLEANER BAG COLLAR

Signed and Sealed this

Twenty-fifth Day of December, 1990

*Attest:*

HARRY F. MANBECK, JR.

*Attesting Officer*

*Commissioner of Patents and Trademarks*